US011963584B2

(12) United States Patent
Koo et al.

(10) Patent No.: US 11,963,584 B2
(45) Date of Patent: Apr. 23, 2024

(54) SHOE HAVING ELASTIC LACE(S) AND LOOPING ELEMENT

(71) Applicant: Dynasty Footwear, Ltd., El Segundo, CA (US)

(72) Inventors: John C. S. Koo, Los Angeles, CA (US); Jose Prochmann, Los Angeles, CA (US)

(73) Assignee: DYNASTY FOOTWEAR, LTD., El Segundo, CA (US)

( * ) Notice: Subject to any disclaimer, the term of this patent is extended or adjusted under 35 U.S.C. 154(b) by 0 days.

(21) Appl. No.: 18/101,012

(22) Filed: Jan. 24, 2023

(65) Prior Publication Data

US 2023/0157416 A1 May 25, 2023

Related U.S. Application Data

(63) Continuation of application No. 17/246,674, filed on May 2, 2021, now Pat. No. 11,564,451, which is a (Continued)

(51) Int. Cl.
*A43C 1/02* (2006.01)
*A43B 23/26* (2006.01)
(Continued)

(52) U.S. Cl.
CPC ..... *A43C 11/002* (2013.01); *A43B 23/26* (2013.01); *A43C 1/003* (2013.01); *A43C 1/02* (2013.01)

(58) Field of Classification Search
CPC .. A43C 1/003; A43C 1/02; A43C 1/04; A43C 3/02; A43C 11/16; A43C 11/165; A43C 11/22; A43B 11/00
See application file for complete search history.

(56) References Cited

U.S. PATENT DOCUMENTS 249,410 A 11/1881 Siegenthaler
312,675 A 2/1885 Turner
(Continued)

FOREIGN PATENT DOCUMENTS

EP 0652720 5/1995
FR 2817449 6/2002
(Continued)

OTHER PUBLICATIONS

Prosecution history of parent U.S. Appl. No. 14/499,130 (now U.S. Pat. No. 9,131,751), as of Aug. 30, 2023.
(Continued)

*Primary Examiner* — Ted Kavanaugh
(74) *Attorney, Agent, or Firm* — LOZA & LOZA, LLP; Joseph G. Swan

(57) ABSTRACT

Provided are, among other things, shoes having elastic tongue-securing straps. In one representative embodiment, a shoe includes: (a) a sole; (b) an upper, extending above the sole, that includes a front section, a left side, a right side, a rear section, and a tongue that originates from the front section and extends rearwardly between the left side and the right side; (c) a left elastic strap that extends from a left side of the tongue and: (1) extends through a loop that is securely attached to the left side of the upper and has a distal end securely attached to the sole, and/or (2) has its distal end securely attached to the left side of the upper; and (d) a right elastic strap that extends from a right side of the tongue and: (1) extends through a loop that is securely attached to the right side of the upper and has a distal end securely attached to the sole, and/or (2) has its distal end securely attached to the right side of the upper, with the left elastic strap having a proximal end fixedly attached to the left side of the tongue and the right elastic strap having a proximal end fixedly attached to the right side of the tongue.

18 Claims, 12 Drawing Sheets

Related U.S. Application Data continuation of application No. 16/420,464, filed on May 23, 2019, now Pat. No. 11,026,480, which is a continuation of application No. 15/673,595, filed on Aug. 10, 2017, now Pat. No. 10,334,910, which is a continuation of application No. 14/848,020, filed on Sep. 8, 2015, now Pat. No. 9,756,903.

(51) Int. Cl.
*A43C 1/00* (2006.01)
*A43C 11/00* (2006.01)

(56) References Cited

U.S. PATENT DOCUMENTS

| | | | | | |
|---|---|---|---|---|---|
| 355,265 | A | | 12/1886 | Hayes | |
| 386,642 | A | * | 7/1888 | Mann | A43C 3/02 24/715.1 |
| 536,345 | A | | 3/1895 | Harris | |
| 789,621 | A | | 5/1905 | Mathewson et al. | |
| 806,267 | A | | 12/1905 | King | |
| 908,704 | A | * | 1/1909 | Sprinkle | A43C 7/00 24/712.1 |
| 970,381 | A | | 9/1910 | Muller | |
| 1,028,598 | A | | 6/1912 | Papp | |
| 1,393,188 | A | * | 10/1921 | Allen | A43C 3/02 24/713.5 |
| 1,585,049 | A | | 6/1924 | Skoglund | |
| 1,759,583 | A | | 5/1930 | Martin | |
| 1,885,297 | A | * | 11/1932 | Santori | A43C 1/02 36/51 |
| 2,004,702 | A | * | 6/1935 | Luttmann, Jr. | A43C 1/02 24/30.5 P |
| 2,266,083 | A | * | 12/1941 | Rzepa | A43C 11/22 24/267 |
| 2,289,225 | A | * | 7/1942 | Tonai | A43C 11/22 24/713.9 |
| 2,346,415 | A | | 4/1944 | Clein et al. | |
| 2,426,524 | A | | 6/1946 | Rosenbarger | |
| 2,607,131 | A | | 9/1948 | Everston | |
| 3,258,862 | A | | 7/1966 | Minor et al. | |
| 3,701,572 | A | * | 10/1972 | Velasquez | A43C 1/02 24/712.4 |
| 4,270,285 | A | | 6/1981 | Antonious | |
| 4,282,657 | A | | 8/1981 | Antonious | |
| 4,361,969 | A | | 12/1982 | Vermonet | |
| 4,451,995 | A | | 6/1984 | Antonious | |
| 4,724,623 | A | | 2/1988 | Silverman | |
| 5,117,567 | A | | 6/1992 | Berger | |
| 5,158,428 | A | * | 10/1992 | Gessner | F16G 11/103 24/712.9 |
| 5,181,331 | A | | 1/1993 | Berger | |
| 5,271,130 | A | | 12/1993 | Batra | |
| 5,337,493 | A | | 8/1994 | Hill | |
| 5,416,987 | A | | 5/1995 | Bemis et al. | |
| 5,651,197 | A | | 7/1997 | James | |
| 5,845,416 | A | | 12/1998 | Hands | |
| 5,992,057 | A | | 11/1999 | Monti | |
| 6,052,921 | A | * | 4/2000 | Oreck | A43C 1/04 36/50.1 |
| 6,199,305 | B1 | | 3/2001 | Steuerwald et al. | |
| 6,367,169 | B1 | | 4/2002 | Barret | |
| 6,474,000 | B2 | | 11/2002 | Burt | |
| 6,502,329 | B1 | * | 1/2003 | Silagy | A43C 1/06 24/713.4 |
| 6,754,983 | B2 | | 6/2004 | Hatfield et al. | |
| 6,823,610 | B1 | | 11/2004 | Ashley | |
| 6,904,706 | B2 | | 6/2005 | Jones et al. | |
| 7,028,420 | B2 | | 4/2006 | Tonkel | |
| 7,062,867 | B2 | | 6/2006 | Meibock | |
| 7,552,547 | B2 | | 6/2009 | Calderone | |
| 7,624,518 | B2 | | 12/2009 | Calderone | |
| 7,770,308 | B2 | | 8/2010 | Leoncini | |
| 7,877,901 | B2 | | 2/2011 | Calderone | |
| 8,316,561 | B2 | | 11/2012 | Jia | |
| 2003/0066207 | A1 | * | 4/2003 | Gaither | A43C 1/04 36/50.1 |
| 2004/0003516 | A1 | | 1/2004 | Jacobs | |
| 2004/0237348 | A1 | * | 12/2004 | Lacey | A43C 11/22 36/51 |
| 2005/0235525 | A1 | | 10/2005 | Jacobs | |
| 2006/0168785 | A1 | * | 8/2006 | Kraft | A43C 9/00 24/715.3 |
| 2006/0168848 | A1 | | 8/2006 | Leoncini | |
| 2007/0068040 | A1 | * | 3/2007 | Farys | A43C 1/04 36/50.1 |
| 2007/0256332 | A1 | | 11/2007 | Calderone | |
| 2008/0060168 | A1 | | 3/2008 | Hammerslag et al. | |
| 2012/0246897 | A1 | * | 10/2012 | Lee | A43C 1/003 24/713.5 |
| 2015/0230558 | A1 | * | 8/2015 | Flores | A43C 1/00 24/72.7 |
| 2015/0305443 | A1 | * | 10/2015 | Kathpalia | A43C 11/165 24/713.6 |

FOREIGN PATENT DOCUMENTS

| | | |
|---|---|---|
| GB | 209365 | 6/1923 |
| GB | 279327 | 4/1927 |
| GB | 2053657 | 2/1981 |
| GB | 2131677 | 6/1984 |

OTHER PUBLICATIONS

Prosecution history of parent U.S. Appl. No. 13/107,180 (now U.S. Pat. No. 8,869,432), as of Aug. 30, 2023.
Prosecution history of parent U.S. Appl. No. 14/848,020 (now U.S. Pat. No. 9,756,903), as of Aug. 30, 2023.
Prosecution history of parent U.S. Appl. No. 15/673,595 (now U.S. Pat. No. 10,334,910), as of Aug. 30, 2023.

* cited by examiner

FIG. 1
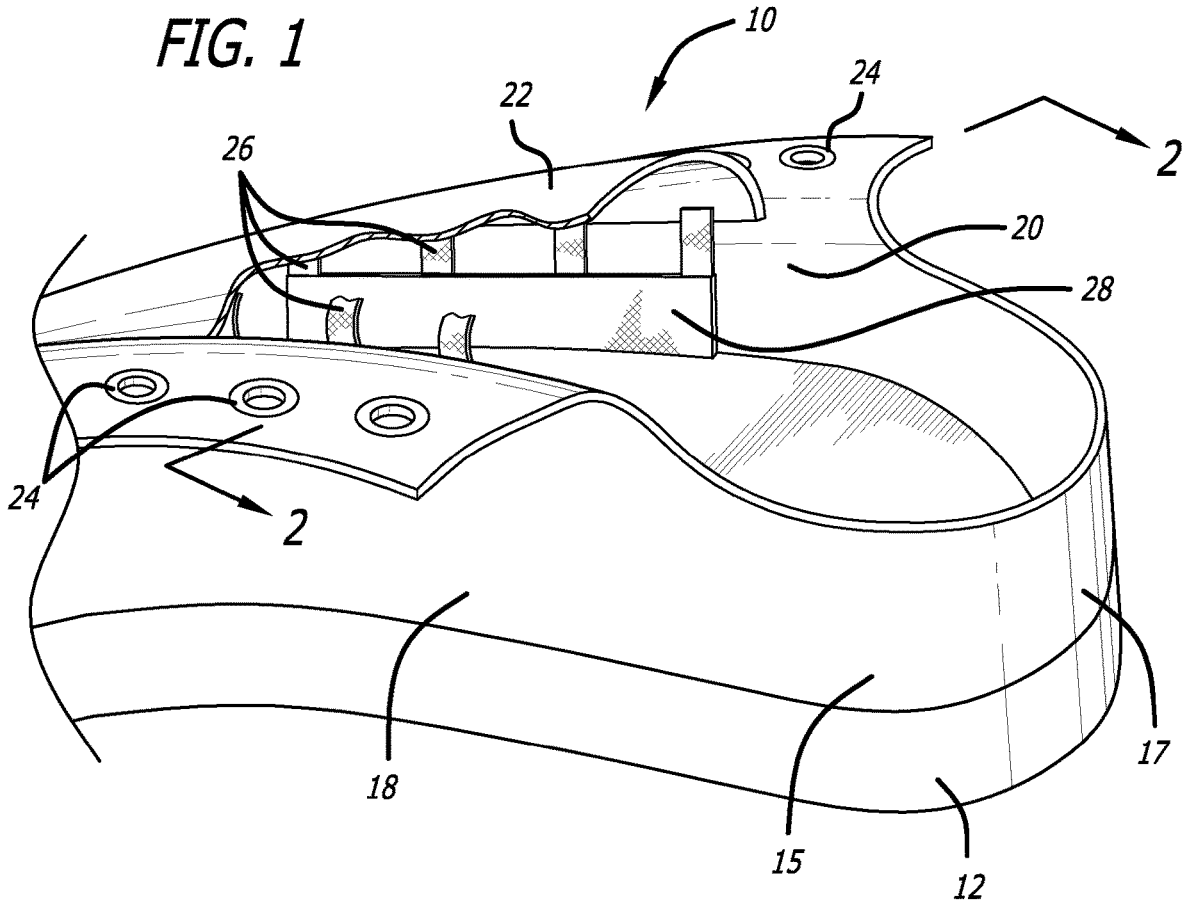
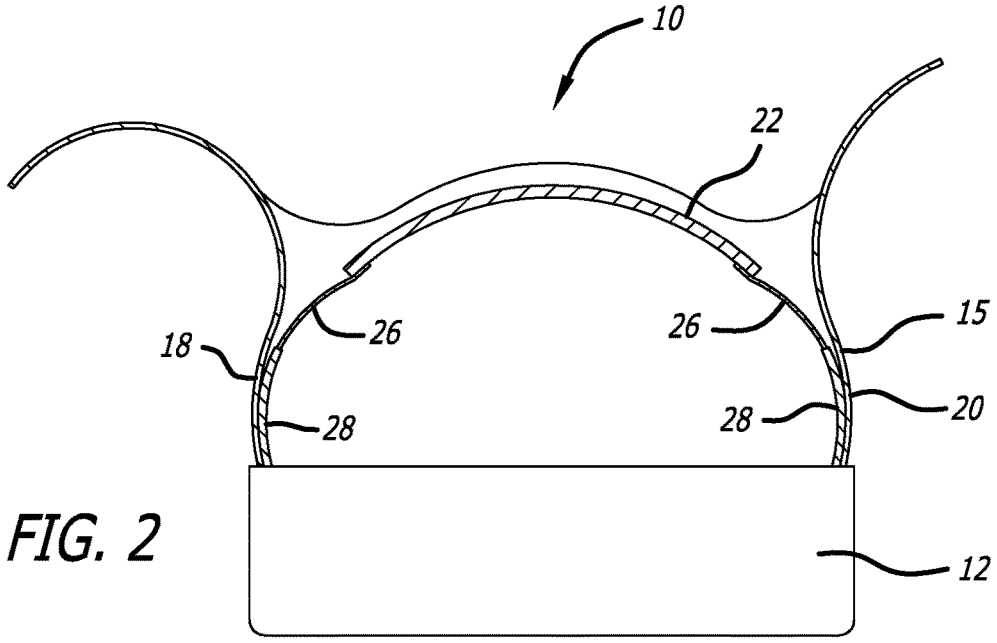
FIG. 2

FIG. 3
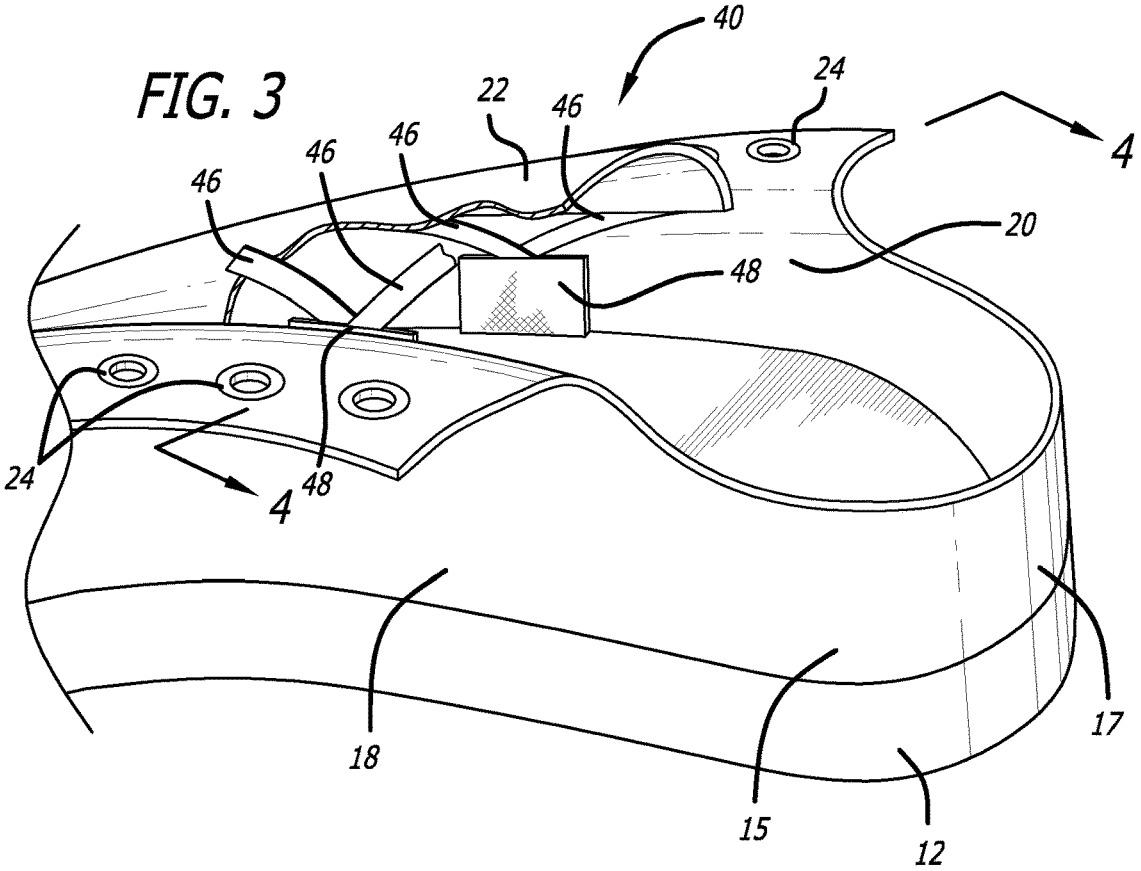
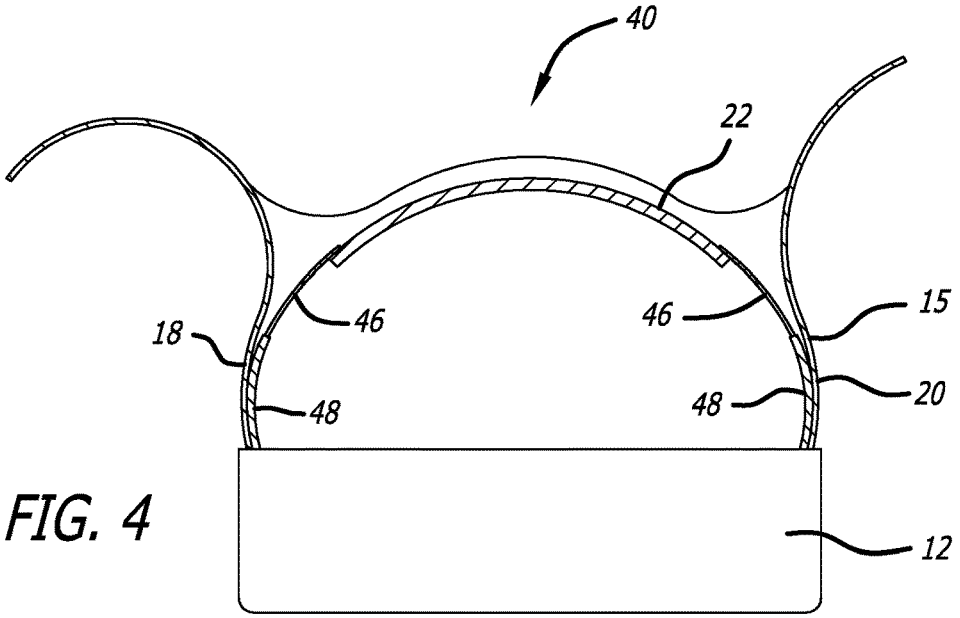
FIG. 4

FIG. 8
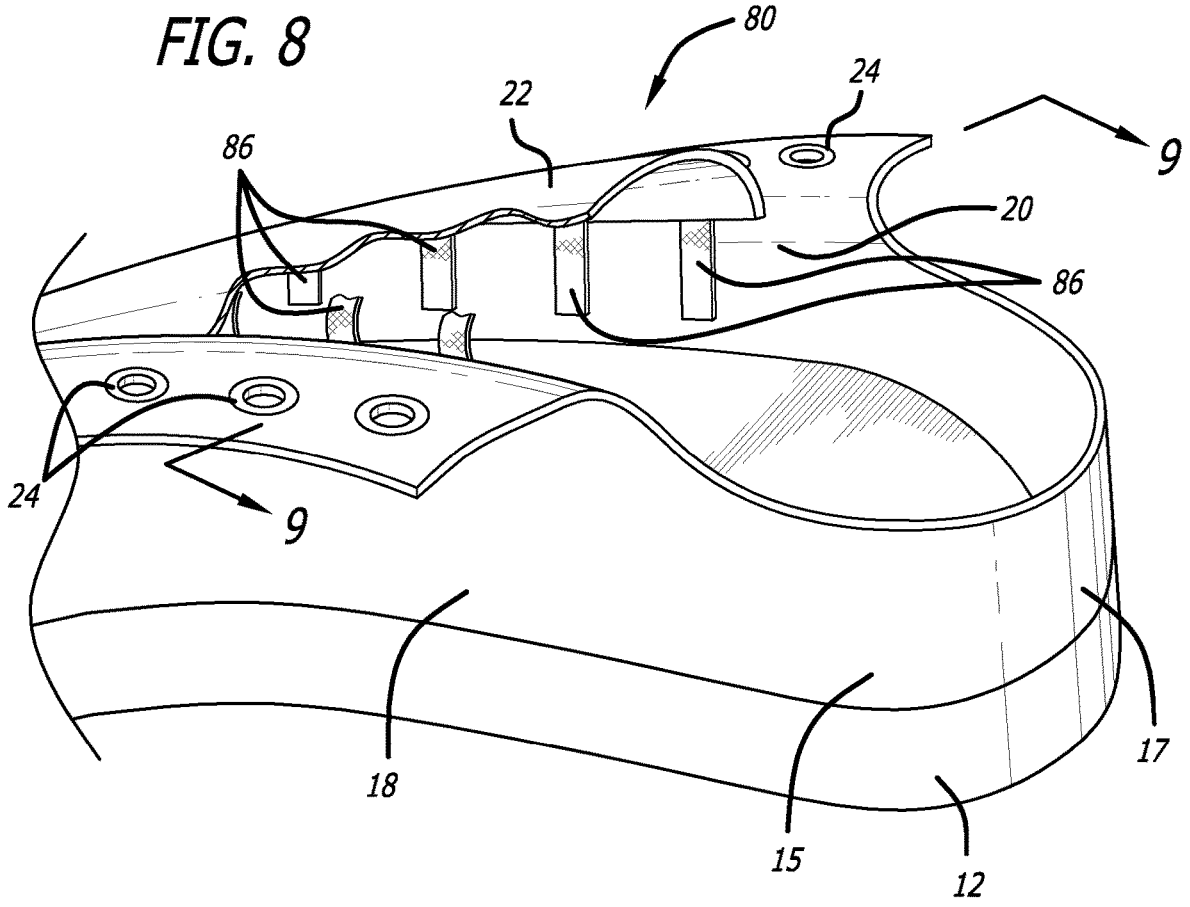
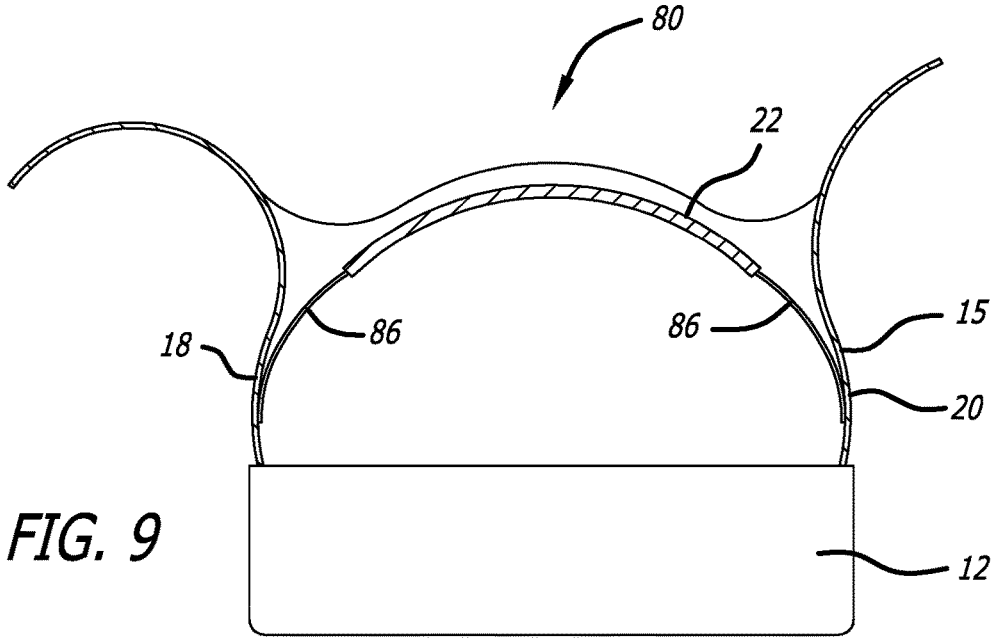
FIG. 9

SHOE HAVING ELASTIC LACE(S) AND LOOPING ELEMENT

FIELD OF THE INVENTION

The present invention pertains to shoes, such as casual shoes and other types of footwear.

BACKGROUND

A variety of different shoe styles exist. However, improvements in shoe designs remain continuously desirable. For example, certain consumers are always looking for unique combinations of aesthetics and functionality in their footwear.

SUMMARY OF THE INVENTION

The present invention addresses these needs by providing shoes in which a plurality of elastic straps secure the shoe's tongue to other portions of the shoe's structure, thereby facilitating ease-of-use, as well as enabling additional shoe styles and additional ways to wear conventional-looking shoes.

Thus, one embodiment of the invention is directed to a shoe that includes: (a) a sole; (b) an upper, extending above the sole, that includes a front section, a left side, a right side, a rear section, and a tongue that originates from the front section and extends rearwardly between the left side and the right side; (c) a left elastic strap that extends from a left side of the tongue and: (1) extends through a loop that is securely attached to the left side of the upper and has a distal end securely attached to the sole, and/or (2) has its distal end securely attached to the left side of the upper; and (d) a right elastic strap that extends from a right side of the tongue and: (1) extends through a loop that is securely attached to the right side of the upper and has a distal end securely attached to the sole, and/or (2) has its distal end securely attached to the right side of the upper, with the left elastic strap having a proximal end fixedly attached to the left side of the tongue and the right elastic strap having a proximal end fixedly attached to the right side of the tongue.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

FIG. 1 is a perspective view of a portion of a shoe according to a first representative embodiment of the present invention.

FIG. 2 is a sectional view of a shoe according to the first representative embodiment of the present invention, taken across the cutline shown in FIG. 1.

FIG. 3 is a perspective view of a portion of a shoe according to a second representative embodiment of the present invention.

FIG. 4 is a sectional view of a shoe according to the second representative embodiment of the present invention, taken across the cutline shown in FIG. 3.

FIG. 8 is a perspective view of a portion of a shoe according to a fourth representative embodiment of the present invention.

FIG. 9 is a sectional view of a shoe according to the fourth representative embodiment of the present invention, taken across the cutline shown in FIG. 8.

DESCRIPTION OF THE PREFERRED EMBODIMENT(S)

Figure 5:
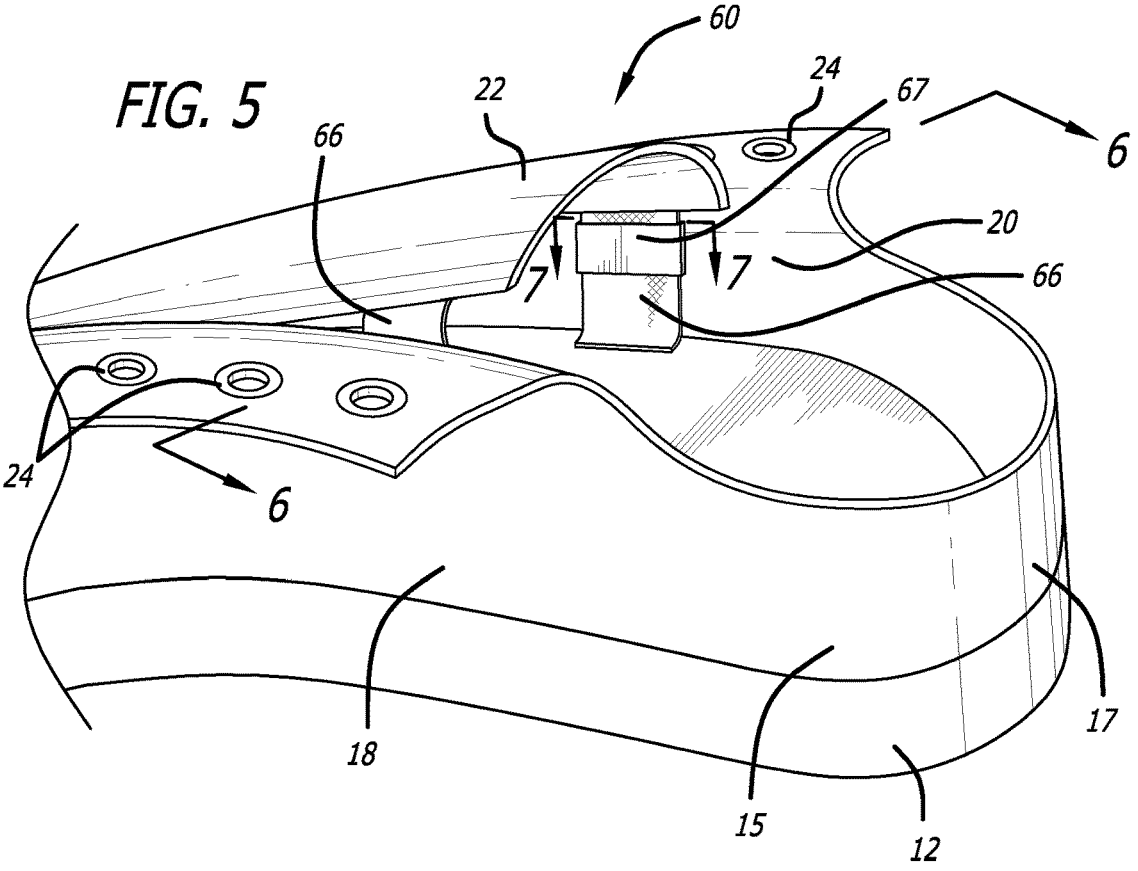
FIG. 5 is a perspective view of a portion of a shoe according to a third representative embodiment of the present invention.

In the preferred embodiments, the present invention concerns a shoe having one or more elastic straps that are securely (and, more preferably, fixedly) attached to each side of the shoe's tongue at their proximal ends and securely attached to a different portion of the shoe at their distal ends. As used herein, the expression "fixedly attached" means incapable of translational movement relative to each other at the attachment point, and the expression "securely attached" means not readily detachable.

The following paragraphs and attached drawings discuss and illustrate certain specific representative embodiments of the present invention. These embodiments generally pertain to a casual shoe, such as a low-top canvas sneaker. However, the structures of the present invention can be used in conjunction with any other kind of shoe or other item of footwear (collectively referred to as "shoes" herein). Although the attached drawings more clearly illustrate the elastic strap(s) on the right side of the shoe for each of these specifically described embodiments, in the preferred embodiments the configuration of the left-side elastic strap(s) is at least approximately a mirror image of the configuration of the right-side elastic strap(s) (or at least is similar, although reversed, as compared to the right-side configuration).

FIGS. 1 and 2 illustrate a shoe 10 according to a first representative embodiment of the present invention. As shown, shoe 10 includes a sole 12 and an upper 15. As with conventional shoes, sole 12 can be formed as a unitary piece or can include plural different layers that have been bonded, molded and/or otherwise joined together. Such different layers can include any or all of: a sock layer that makes contact with the wearer's foot, an insole immediately beneath the sock layer or forming the inner surface of the sole 12 in the event that a sock layer is not provided, an outsole that contacts the ground in ordinary use, and/or a midsole disposed between the insole and the outsole.

The upper 15 includes a rear section 17, a left side 18, a right side 20 and a front section (not shown) to which a tongue 22 is attached. As with conventional shoes, tongue 22 extends rearwardly from the front section of the shoe's upper 15, between and somewhat underneath the left side 18 and the right side 20. Each of left side 18 and right side 20 preferably also includes a plurality of eyelets 24 (e.g., comprised of plastic or metal grommets) through which shoelaces (not shown) may be threaded.

Shoe 10 also includes a plurality of relatively thin elastic straps 26 extending (preferably in an approximately parallel orientation to each other) from each side of tongue 22 (preferably at an approximately right angle to the tongue 22). In the present embodiment, the proximal end of each of such elastic straps 26 is fixedly attached to its corresponding side of the tongue, preferably along the outer one-third (⅓) or outer one-quarter (¼) of the tongue's width. More specifically, in the present embodiment the proximal end of each of the elastic straps 26 is attached to the underside of the tongue 22, e.g., through the use of stitching, adhesive material or any combination of the two. However, as discussed below and illustrated in the other drawings, in alternate embodiments, any of the elastic straps according to the present invention instead may be attached to the top side or between layers of the tongue 22. Although four elastic straps 26 are shown on each side of tongue 22 in FIG. 1, any other number instead may be used. In any event, such elastic straps 26 preferably are distributed across the length of tongue 22, or at least its rear half. In certain embodiments, use of plural elastic straps (e.g., straps 26) along each side of tongue 22 can, in certain respects, provide results that are similar to lacing.

In the present embodiment, the distal ends of the elastic straps 26 on each side of the tongue 22 are securely attached to an elongated attachment strip 28, e.g., through the use of stitching, adhesive material, one or more attachment joints (e.g., mechanical joints that permit rotation and/or pivoting), or any combination of the foregoing. In addition, e.g., elastic straps 26 may be attached to either side of attachment strip 28 or may be attached between two layers that make up attachment strip 28. Preferably, attachment strip 28 also is relatively thin, elongated and elastic (although, more preferably, it is thicker, wider and/or otherwise provides greater elastic tension than elastic straps 26), but is oriented at an approximately right angle to the elastic straps 26 (i.e., parallel to the corresponding left side 18 or right side 20 of the shoe's upper 15). The bottom edge of attachment strip 28 preferably is securely attached to the shoe sole 12, e.g., by stitching and/or gluing it to the top surface of shoe sole 12 or by inserting it between adjacent layers of the sole 12 prior to attaching them together. In addition, or instead, the top edge, bottom edge and/or midsection of attachment strip 28, or any portion thereof, may be securely attached to the corresponding left side 18 or right side 20 of the shoe's upper 15. In any event, the use of an attachment strip (such as attachment strip 28) according to the present invention often can provide a kind of free-floating structure for the elastic straps (e.g., straps 26).

FIGS. 3 and 4 illustrate a shoe 40 according to an alternate embodiment of the present invention. Shoe 40 includes a plurality of elastic straps 46 that extend from each side of the shoe's tongue 22 and attach to an attachment strip 48. However, in the present embodiment, elastic straps 46, although extending from different points along a respective side of tongue 22, converge and attach to attachment strip 48 at a single point. Otherwise, elastic straps 46 and the considerations pertaining to them may be the same as for elastic straps 26, described above. Similarly, attachment strip 48 and the considerations pertaining to it may be the same as for attachment strip 28, described above. Although only two elastic straps 46 are shown in FIG. 3 extending from each side of tongue 22, any other number instead may be used. For embodiments that include more than two elastic straps 46 on each side of tongue 22, all of such elastic straps 46 may converge to a single point, or subsets (e.g., adjacent pairs) of the elastic straps 46 may converge to different points (e.g., with multiple attachments strips 48, one for each such point, or with a single elongated attachment strip 48). Finally, the techniques, options and considerations for attaching the elastic straps 46 and attachment strip 48 may be the same as those discussed above for elastic straps 26 and attachment strip 28, respectively. It is noted that in this particular embodiment, elastic straps 46 are illustrated in FIG. 4 as being attached to the top side of tongue 22, although they could instead be attached in any of the other ways described herein.

Figure 6:
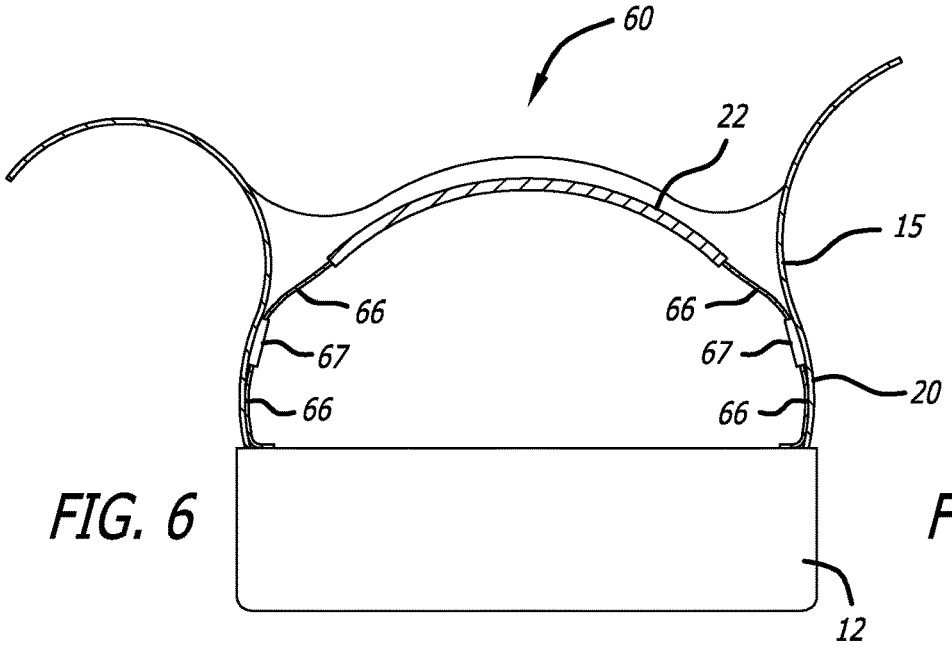
FIG. 6 is a sectional view of a shoe according to the third representative embodiment of the present invention, taken across the corresponding cutline shown in FIG. 5.
Figure 7:
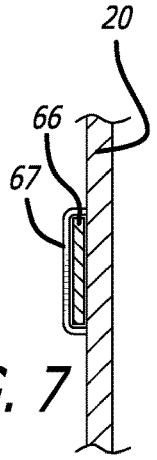
FIG. 7 is a sectional view of a portion of the right side of an upper, together with an attached loop and a strap passing through the loop, according to the third representative embodiment of the present invention, taken across the corresponding cutline shown in FIG. 5.

Another embodiment of a shoe 60 according to the present invention is illustrated in FIGS. 5-7. In shoe 60, an elastic strap 66 extends from each side of tongue 22 and through a loop 67 that itself preferably is securely attached to the corresponding left side 18 or right side 20 of the shoe's upper 15 (preferably the top portion of such left side 18 or right side 20, near the eyelets 24, just beneath the tongue 22 and/or in the upper two thirds or even in the upper one third of the distance between the shoe's sole 12 and the bottom edge of the tongue 22). The proximal end of each such elastic strap 66 preferably is fixedly attached to the corresponding side of tongue 22 (e.g., in any of the ways described above for elastic straps 26), and the distal end of each such elastic strap 66 preferably is securely attached to the shoe's sole 12 (e.g., using stitching and/or adhesive material, and/or in any of the other ways described above for attaching attachment strip 28 to shoe sole 12 or for attaching elastic straps 26 to attachment strip 28). It is noted that elastic strap 66 is illustrated in FIG. 6 as being attached to tongue 22 between adjacent layers that make up tongue 22, so the elastic strap 66 extends from the middle of tongue 22; however, any of the other attachment techniques described herein instead may be used. Although only a single elastic strap 66 and loop 67 is illustrated in the drawings on each side of tongue 22, any other number instead may be used. Similarly, when using multiple elastic straps 66 on each side of tongue 22, each such elastic strap 66 may be provided with its own loop 67, or a single elongated loop may be provided for multiple (e.g., all) elastic straps 66 on the same side of the tongue 22. In any event, in the preferred embodiments loop 67 preferably is made of a thin, smooth, flexible fabric material, so as to not interfere with the wearer's comfort, while simultaneously allowing its corresponding elastic strap(s) 66 to easily slide through it.

FIGS. 8 and 9 illustrate a further embodiment of a shoe 80 according to the present invention. In this embodiment, shoe 80 includes a plurality of elastic straps 86 extending from each side of the shoe's tongue 22. Elastic straps 86 (and the considerations pertaining to them) can be similar or identical to elastic straps 26 that were described above, but rather than having their distal ends attached to an attachment strip (as with shoe 10), the distal ends of elastic straps 86 instead preferably are securely attached to the corresponding left side 18 or right side 20 of the shoe's upper 15. Such attachment can be effected, e.g., using stitching and/or adhesive material, and the point(s) at which some or all (i.e., at least one and, more preferably, a majority, all or substantially all) of such elastic straps 86 attach to left side 18 or right side 20 of the shoe's upper 15 preferably are in the upper two thirds or, more preferably, in the upper one third of the distance between the shoe's sole 12 and the bottom edge of the tongue 22.

Figure 10:
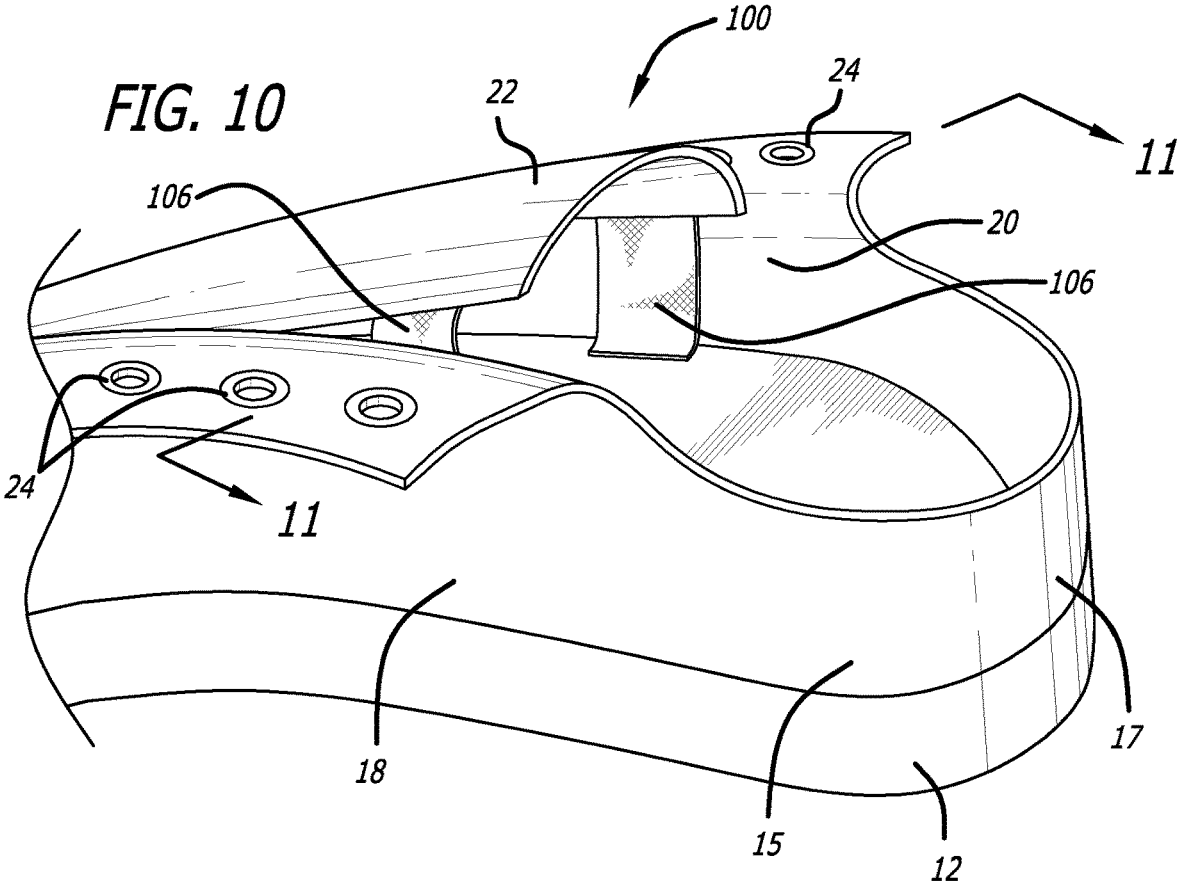
FIG. 10 is a perspective view of a portion of a shoe according to a fifth representative embodiment of the present invention.
Figure 11:
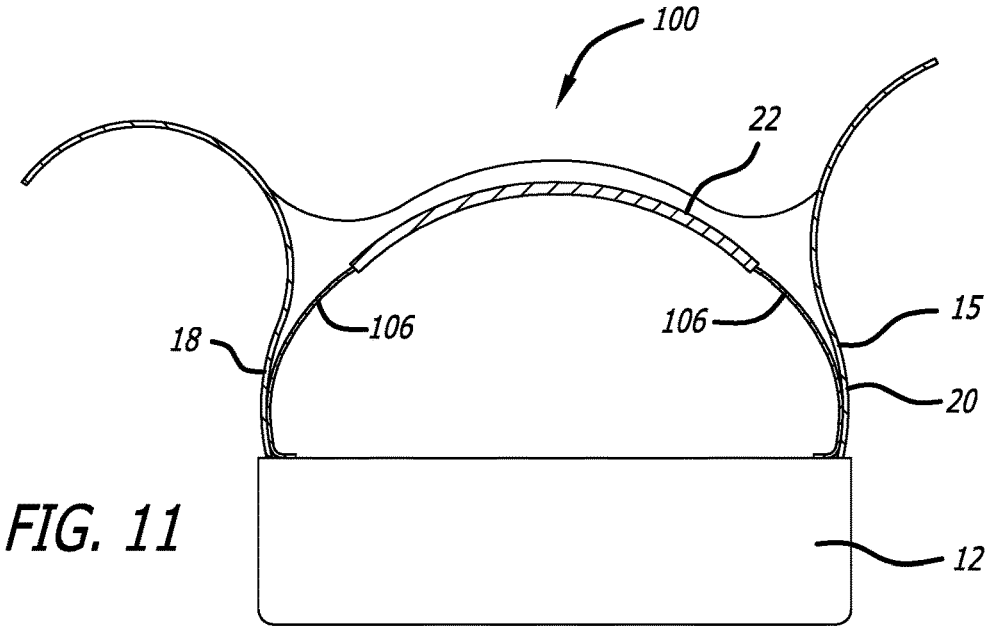
FIG. 11 is a sectional view of a shoe according to the fifth representative embodiment of the present invention, taken across the cutline shown in FIG. 3.

FIGS. 10 and 11 illustrate a still further embodiment of a shoe 100 according to the present invention. In this embodiment, on each side of the tongue 22 an elastic strap 106 preferably is fixedly attached to the tongue 22 at its proximal and preferably is securely attached to the shoe's sole 12 at its distal end. However, in alternate embodiments, the proximal and distal ends of each strap 106 may be attached in any of the other ways described herein. Also, any portion of any of the straps 106 may be attached to the corresponding left side 18 or right side 20 of the shoe's upper 15. Although only a single wide elastic strap 106 is shown in FIG. 10 on each side of tongue 22, any other number of elastic straps 106 instead can be used.

In certain embodiments discussed above, elements are described as being attached to the left side 18 or right side 20 of the shoe's upper 15. Preferably, each such attachment is to the inner surface of such left side 18 or right side 20.

In each of the embodiments described above, elastic straps are used to pull or hold a shoe's tongue in a down (or at least lower) position. In certain embodiments, the aggregate tension provided by such elastic straps is strong enough (e.g., using a small number of wider and/or higher-tension straps or a larger number of narrower and/or somewhat lower-tension straps) to hold the shoe onto the wearer's foot. As a result, it can be possible for the wearer to slide his or her foot into the shoe without tying the shoelaces, or even to wear the shoe without shoelaces at all. Not only does this approach provide for greater convenience, but it also can provide the wearer with a means to make different kinds of fashion statements, e.g., wearing shoes with the laces untied or wearing shoes that have lace-up eyelets 24 but no laces through them.

Figure 12:
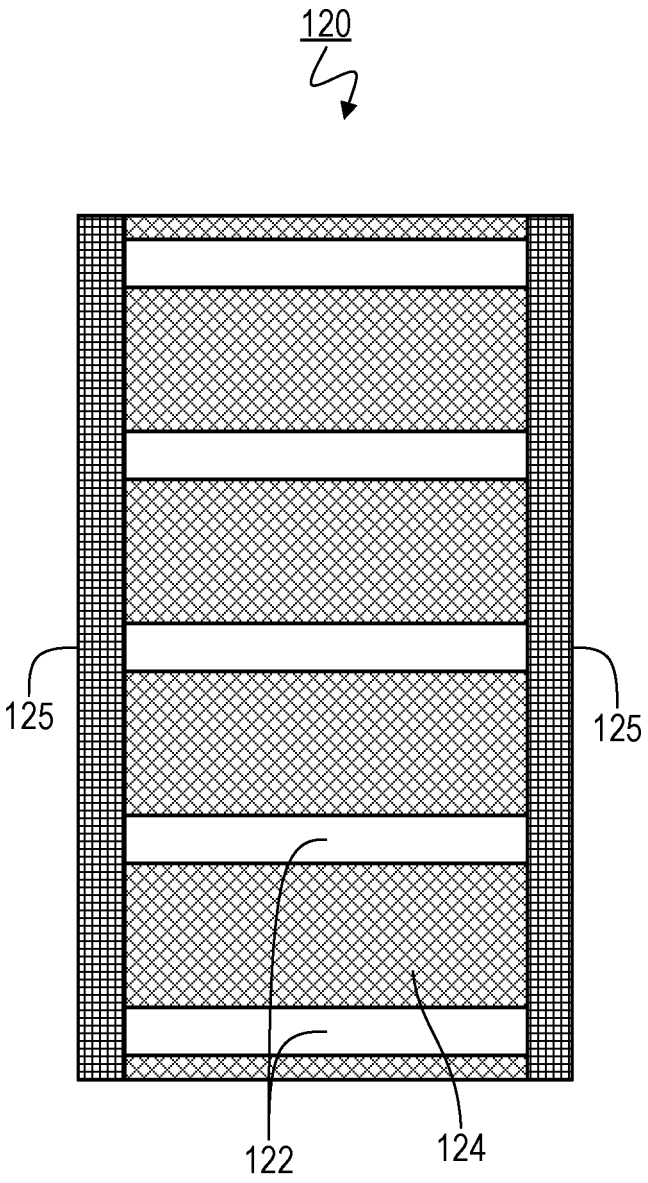
FIG. 12 is a top plan view of a piece of composite material that includes a plurality of elastic straps that are joined together using a different kind of material, e.g., to facilitate attachment of such elastic straps to different portions of a shoe.

Also, in some of the embodiments described above, plural elastic straps extend from each side of the shoe's tongue 22. In these embodiments some or all of the adjacent individual elastic straps (on one or both sides of the tongue 22) can be replaced by a single piece of material, such as a single piece of uniformly elastic material. Alternatively, such adjacent individual elastic straps can be replaced by a single piece of material 120, as illustrated in FIG. 12, having plural straps of elastic material 122 (e.g., arranged in a parallel or approximately parallel configuration) joined together with a different kind of material 124 (e.g. a mesh-like material or other material having a lower-tension elasticity). Optionally, material 120 also has stronger and/or reinforced strips 125 along its sides where the piece of material 120 is stitched or otherwise attached (e.g., along one edge 125, to the tongue 22 and, along the other edge 125, to the corresponding left side 18 or right side 20 of the shoe's upper 15 or to the shoe's sole 12). Although shown in FIG. 12 as a rectangular piece, material 120 instead can be formed in any other shape, e.g., with edges that conform to the shape of the tongue 22 on one side and conform to the shape of the junction between the sole 12 and corresponding left side 18 or right side 20 of the shoe's upper 15 on the other. In any event, using such a piece of material 120 often can facilitate assembly of the shoe when plural elastic straps are desired on each side of the tongue 22.

Further Embodiments

Figure 13A:
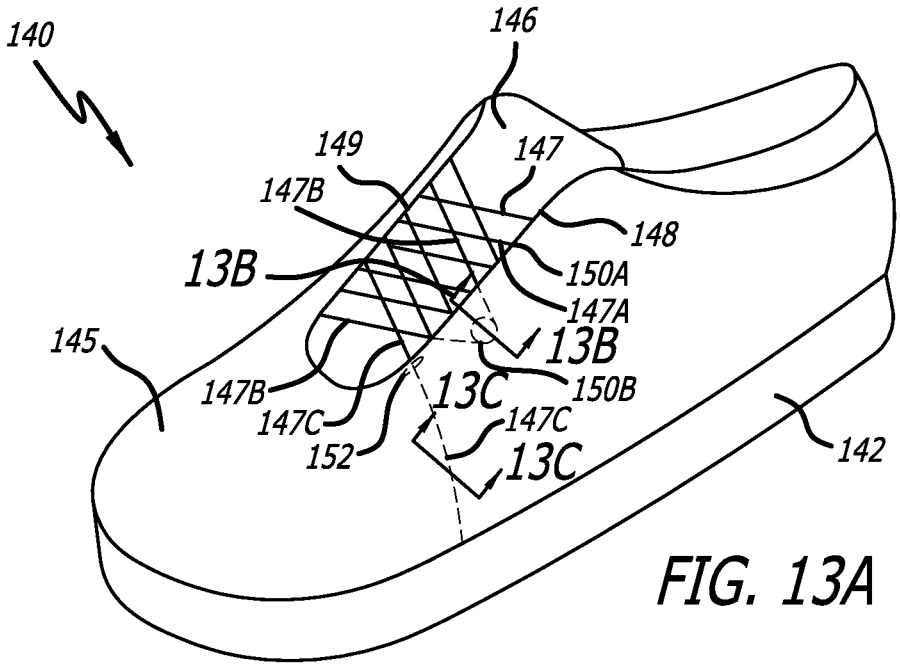
FIG. 13A is a perspective view of a shoe according to a sixth representative embodiment of the present invention.
Figure 13B:
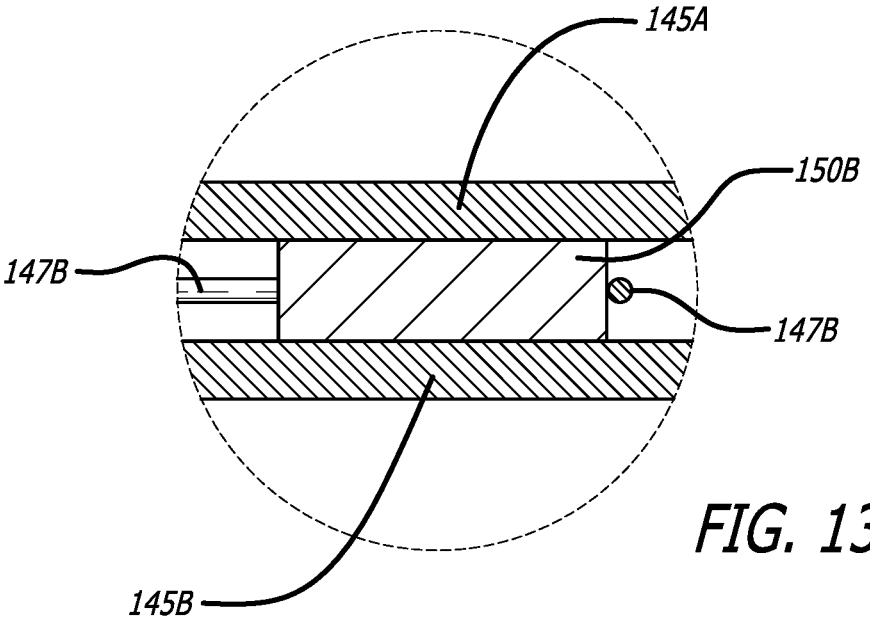
FIG. 13B is a sectional view taken along the indicated cutline in FIG. 13A.
Figure 13C:
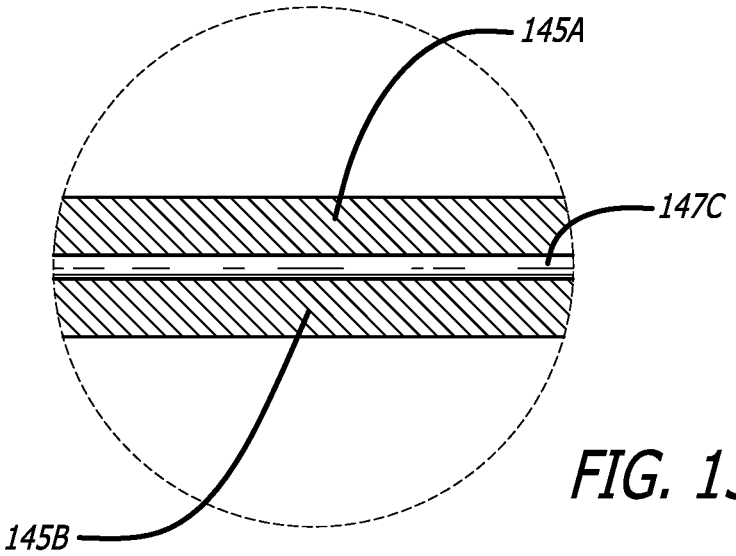
FIG. 13C is a sectional view taken along the indicated cutline in FIG. 13A.

Another shoe 140 according to the present invention is illustrated in FIGS. 13A-C. As shown, shoe 140 includes a sole 142 and an upper 145. Upper 145, in turn, includes a tongue 146 and one or more elastic lace(s) 147 that extend over and across the tongue 146 from a left side 148 to a right side 149 (or vice versa) of the approximately U-shaped forefoot opening in the upper 145 (under which the tongue 146 is disposed). In certain embodiments, each illustrated segment of elastic lace 147 (such as segment 147A) is in fact a separate segment of lace 147, extending just one time from left side 148 to right side 149 of the illustrated opening, and with its ends (e.g., lace end 150A) securely attached to the corresponding left and right sides of the upper 145 (e.g., having been stitched and/or glued at or near the edges of sides 148 and 149). In alternate embodiments, a single segment of elastic lace 147 (such as lace segment 147B) crosses over the tongue 146 two or more times, e.g., with the elastic lace segment 147B looping around a static or rotatable element 150B that is disposed inside of, or embedded within (e.g., between layers 145A&B of), the upper 145. Such an alternate configuration, in which a single segment of lace 147 crosses the tongue 146 (or, in the present embodiment, correspondingly, the forefoot opening above it) sometimes can allow for easier construction of the shoe 140, particularly when trying to adjust the elastic lace(s) 147 so as to have a desired amount of tension (e.g., when shoe 140 is in its default state, as illustrated in FIG. 13A). In addition, using a rotatable looping element 150B often can reduce friction and, e.g., thereby allow a looped lace 147B to be more easily pulled into, and then subsequently maintained in, a more constant amount of tension throughout its entire length.

Attaching flexible lace(s) 147 close to the edges of forefoot opening sides 148 and 149 often can provide for greater comfort and ease-of-use by avoiding having such lace(s) 147 extend for any significant distance within the interior of shoe 140, which could make it difficult for the wearer to properly insert his or her foot without interference from such lace(s) 147 and/or could uncomfortably press against the wearer's foot when the shoe 140 is being worn. Thus, in the present embodiments, the lace(s) 147 is/are attached, either fixedly (e.g., with respect to lace 147A) or slidably (e.g., with respect to lace 147B) close to the edge(s) of forefoot opening side(s) 148 and 149, as applicable. More preferably, they are attached above the tongue 146 so that the tongue 146 acts as a barrier between the lace(s) 147 and the wearer's foot.

Another variation, which addresses such potential problems while simultaneously permitting the subject lace(s) 147 to be anchored close to the base of the shoe 140, is to run the lace(s) 147 (e.g., lace 147C) between layers 145A&B of the upper 145, e.g., starting at an opening 152 within an inner layer 145B of upper 145 (when upper 145 is constructed of plural layers, i.e., at least one inner layer 145B and one outer layer 145A), with opening 152 preferably being close to the edge of the corresponding forefoot opening side 148 or 149. In this way, the lace(s) 147 can be slidably attached to upper 145 at their respective opening(s) (e.g., opening 152), near the edges of forefoot opening sides 148 and 149, and also can be fixedly attached to the upper 145 at a lower point (e.g., closer to the sole 142) or else can even be fixedly attached to the sole 142 itself. Still further, as shown in FIG. 13A, any one or any combination of these or other configurations (e.g., for routing and/or attaching laces 147) can be used within a single shoe 140, or even for a single lace segment 147 (e.g., with one end fixedly attached close to the edges of sides 148 and 149, a middle portion looped around an element 150B, and its other end fed through an opening 152 in an inner wall of upper and then fixedly attached lower on the upper 145 or to the sole 142). In any event, in the current embodiment, the individual elastic laces 147 (or at least segments of laces 147) cross over each other within the forefoot opening of the upper 145, as shown.

The lace(s) 147 discussed in the preceding embodiments represent one type of elastic strap that can be used for securing an upper to a wearer's foot. Generally speaking, lace(s) 147 will be relatively narrow and often tubular-shaped, often meaning that any contact with the wearer's foot will be somewhat noticeable, if not actually uncomfortable.

Figure 14:
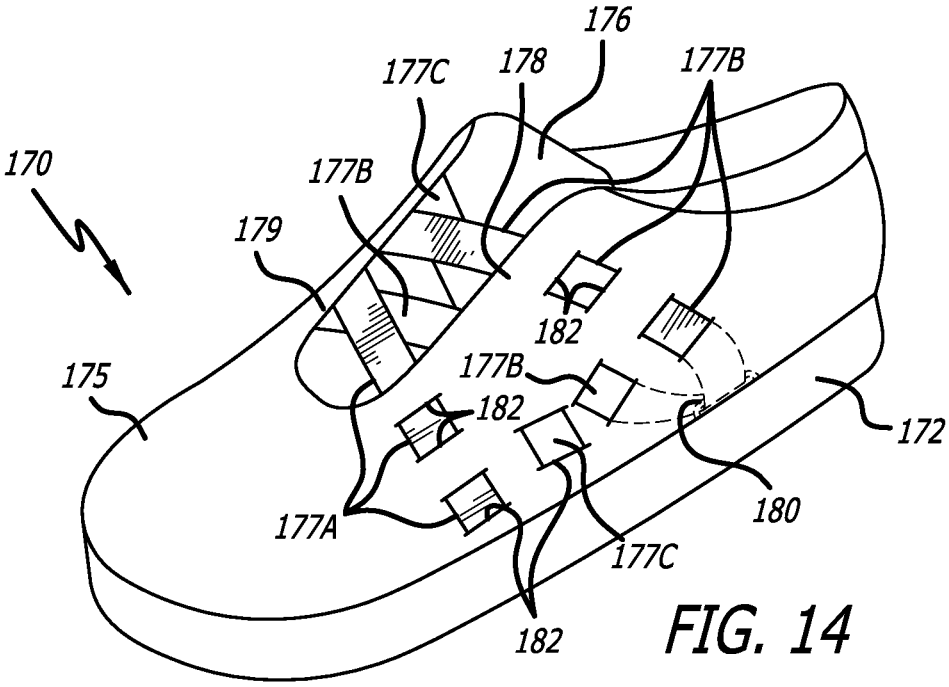
FIG. 14 is a perspective view of a shoe according to a seventh representative embodiment of the present invention.

Partially to accommodate such contact, shoe 170, shown in FIG. 14 instead uses a relatively wide, flat strap 177 (e.g., straps 177A-C, collectively referred to as straps 177 or sometimes individually as a strap 177). As shown, shoe 170 includes a sole 172, an upper 175 and a tongue 176. Elastic straps 177 extend over and across the tongue 176 from a left side 178 to a right side 179 of the approximately U-shaped forefoot opening in the upper 175, under which the tongue 176 is disposed. After crossing such opening, in the current embodiment straps 177 initially extend along the interior surface of the sidewall of upper 175 and then passes through an opening 182, so as to run along the outside of the sidewall of the upper 175 for a certain distance before reentering the interior of the upper 175 (through another opening 182). This weaving out of and then back into the upper 175 can be repeated one or more additional times before, e.g., a given strap 177 fixedly attaches to the rest of the shoe 170 (e.g., by being stitched and/or glued to a lower portion of the upper 175, e.g., near the sole 172, or even to the shoe's sole 172 itself). In the current embodiment, individual elastic straps 177 (or at least segments of such straps 177) cross over each other within the forefoot opening of the upper 175, as shown. Although not shown, a similar or identical structure to that shown in FIG. 14 preferably is provided on the right side of the shoe 170, with the strap(s) 177 partially extending along the interior of the upper 175 and partially extending along its exterior.

Certain benefits of such a structure include the ability to more fully secure the upper 175 around the wearer's foot while simultaneously providing a sufficient level of comfort and greater uniformity of pressure on the wearer's foot (as compared to most conventional shoes in which all or almost all of the holding forces are provided across the top of the wearer's foot. In certain more-specific embodiments, the main body of the upper 175 is made of a cloth, fabric or other highly flexible and/or pliable material, which is able to more closely conform to the wearer's foot as a result of the tension provided by strap(s) 177.

Similar to shoe 140, each of straps 177A-C can be implemented as a single, discrete strap segment or, alternatively, an individual strap 177 (such as strap 177B) can be looped back, e.g., around a static or rotatable looping element 180 (disposed on the outside of or, as shown in FIG. 14, within the interior of the shoe 170), so as to cross over the tongue 176 two or more times. More preferably, any such looping element 180 is cylindrically shaped in order to accommodate the present broad, flat elastic straps 177 being used.

Figure 15:
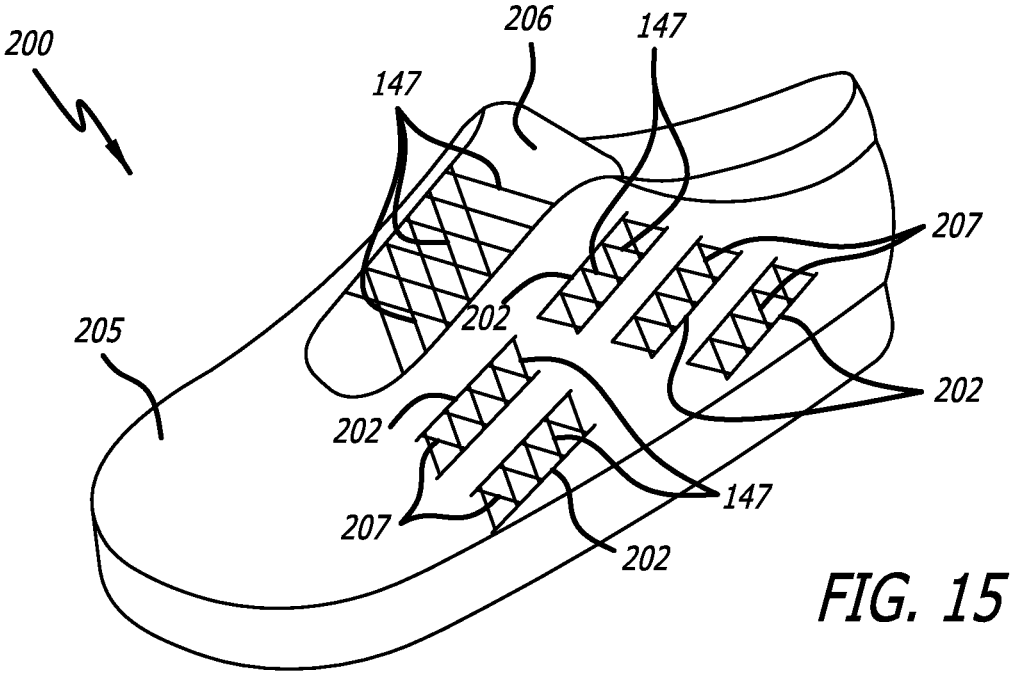
FIG. 15 is a perspective view of a shoe according to an eighth representative embodiment of the present invention.

According to a still further embodiment, shoe 200, shown in FIG. 15, includes elastic laces 147 (or at least segments of laces 147) extending over and across the shoe's tongue 206, similar to shoe 140 shown in FIG. 13A. However, in shoe 200 the laces 147 are woven inside and outside of the sidewalls of the shoe's upper 205 through openings 202, similar to the manner in which the straps 177 (discussed above) are woven through openings 182 in the sidewalls of the upper 175 of shoe 170. In the present embodiment, cross-laces 207, which cross the laces 147 between adjacent pairs of such openings 202 exterior to the sidewall of the shoe's upper 205 (e.g., on the interior sides of such laces 147, on their exterior sides, or with some inside and some outside), are used in order to help anchor laces 147 and/or to provide a desired aesthetic effect. In the present embodiment, these cross-laces 207 are just short lace segments (e.g., attached to the interior of the sidewall of upper 205 and/or extending between layers of such sidewalls), e.g., just a little longer than necessary to traverse the corresponding openings 202. However, in alternate embodiments they can extend longer and even be extensions of other laces 147 (e.g., redirected by looping the corresponding laces 147 around a looping structure disposed on the interior of the upper 205).

Figure 16:
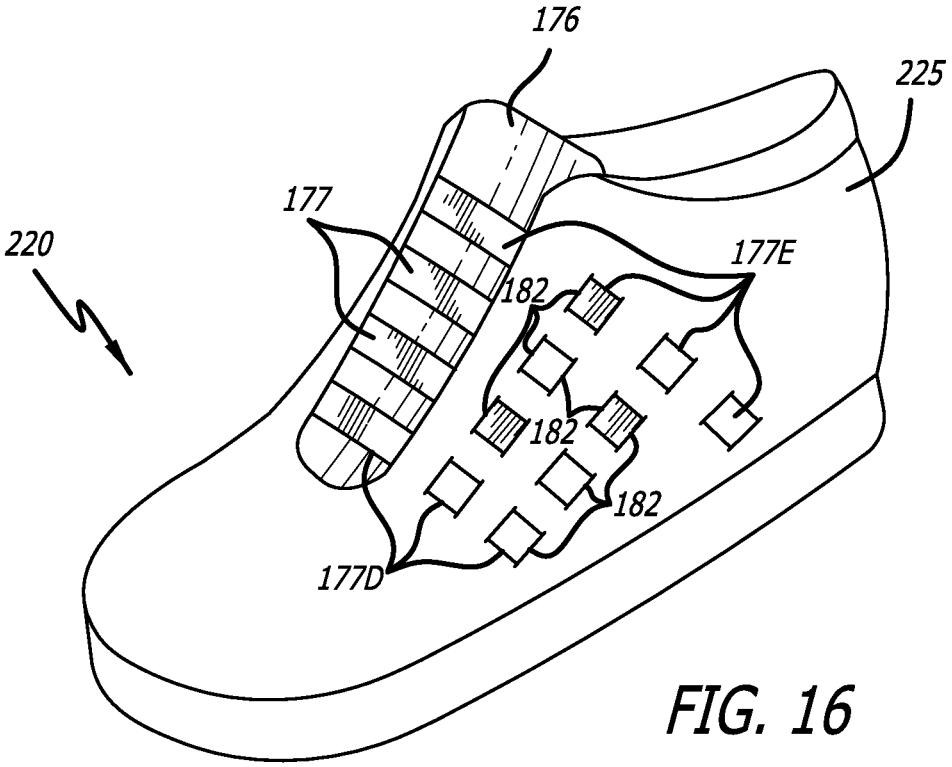
FIG. 16 is a perspective view of a shoe according to a ninth representative embodiment of the present invention.

According to a still further embodiment, shoe 220, shown in FIG. 16, is similar to shoe 170, shown in FIG. 14, but instead of the straps 177 crossing over each other, they run parallel (or approximately parallel) to each other when passing over tongue 176 (e.g., across the forefoot opening) and when woven through openings (e.g., slits) 182 in the sidewalls of the upper 225 of shoe 220.

In the preceding embodiments discussed in relation to FIGS. 13-16, each subject shoe is illustrated as being a kind of sneaker or athletic shoe. However, such depictions should not be understood as limiting. Similar kinds of strap configurations can be applied to any other type of shoe.

Figure 17:
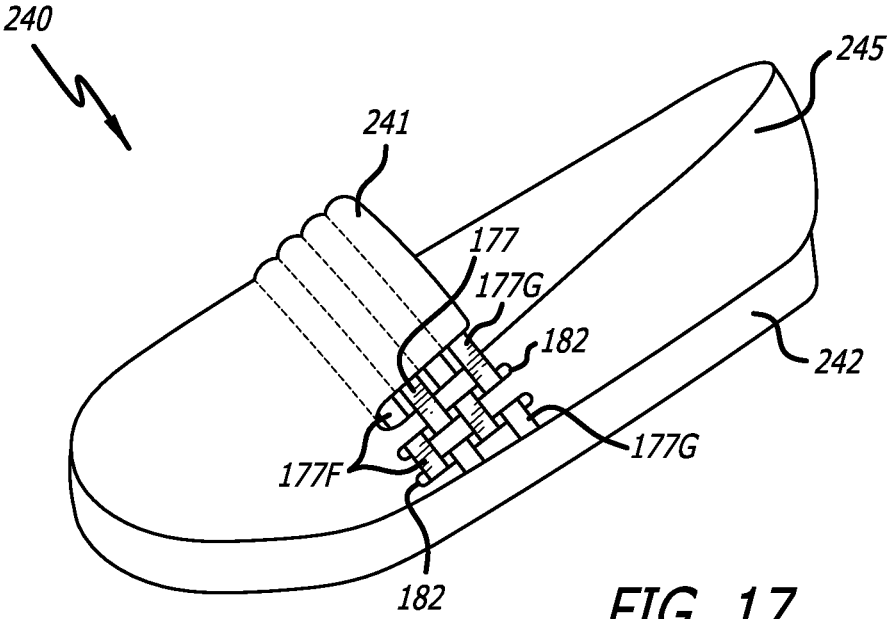
FIG. 17 is a perspective view of a shoe according to a tenth representative embodiment of the present invention.

For instance, shoe 240 (shown in FIG. 17) also involves a sequence of elastic straps 177 (such as straps 177F&G) that extend from the side edges of the tongue 241 and then are woven through openings 182 in the sidewall of the upper 245 of shoe 240. However, in this embodiment, shoe 240 is of a loafer style and, rather than extending across a forefoot opening, as in the previous embodiments, straps 177 attach to the tongue 241 (more specifically, in the current embodiment, the side edges of the tongue 241) of shoe 240. In the present embodiment, straps 177 are sewn in between layers of material that make up tongue 241, and each extends all the way from the left side of the shoe 240 to its right side. However, in alternate embodiments separate left-side and right-side straps (e.g., each attaching to the corresponding side of tongue 241) are used. In any event, as with some of the previous embodiments, straps 177 are woven through openings 182, so as to partially run along the inside surface of the sidewalls of upper 245 and to partially run along its outside surface, ultimately attaching to a position near the bottom of upper 245 or to the sole 242 (with some or all of such straps 177 attaching on the inside and/or the outside of shoe 240).

Figure 18:
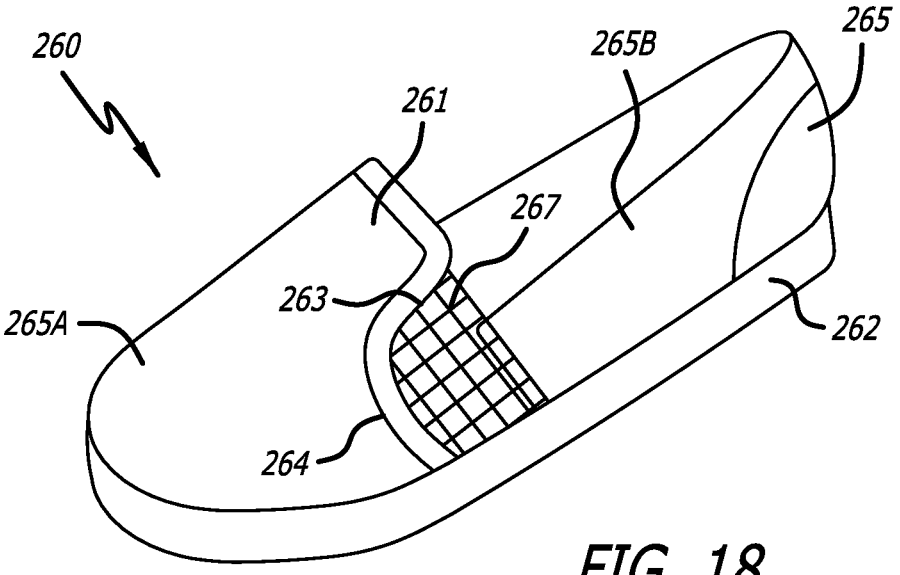
FIG. 18 is a perspective view of a shoe according to an eleventh representative embodiment of the present invention.

FIG. 18 illustrates another shoe 260 in the loafer style. In this embodiment, however, an elastic web 267 extends from each side edge (e.g., left edge 263) of the tongue 261. As shown, web 267 includes a first set of elastic segments (typically parallel or at least approximately parallel to each other) oriented in one direction and a second set of elastic segments (also, typically parallel or at least approximately parallel to each other) oriented in a second (e.g., orthogonal) direction that together form a web or mesh-like structure. In the present embodiment, with reference to the left side of shoe 260 (which is shown in FIG. 18), the segments in the first set attach at one end to the left longitudinal edge 263 and at the other end to points along the bottom of the sidewall of upper 265 and/or to points on sole 262, and the segments in the second set attach at one end to the left vertical (or approximately vertical) edge 264 of the toe cap 265A and at the other end to the rearmost segment in the first set.

As depicted in FIG. 18, web 267 is disposed entirely on the outside of the upper 265, and there exists a gap between the toe cap 265A and the rear portion 265B of the upper 265. However, in alternate embodiments web 267 is disposed entirely within upper 265 or partly inside of and partly outside of upper 265 (e.g., using a weaving structure, as discussed above in connection with some of the previous embodiments), and/or rear portion 265B is extended so as to contact (e.g., attach to) toe cap 265A. Also, in the present embodiment web 267 consists only of crossing first and second segments, which collectively define a grid of openings. However, in alternate embodiments such segments are attached to or embedded within an elastic sheet material, which can function as a support substrate (e.g., with the first and second crossing segments providing most of the strength and with the sheet material primarily providing a decorative or aesthetic effect, such as by covering the openings that otherwise would exist in its absence).

Shoe 280 (shown in FIG. 19) is similar to shoe 220, discussed above, but rather than using flat elastic straps 177, shoe 280 instead uses plural (in this specific embodiment, three) sections (or strips) of elastic web 267 (e.g., strips 267A&B), e.g., of the type of material discussed in the immediately preceding embodiment. Also, shoe 280 has a lower upper than shoe 220, although either style of shoe can be used in either embodiment, or in any of the other embodiments discussed herein, for that matter. Similar to shoe 220, in the present embodiment, such strips of web 267 cross over the top of the tongue 286 (e.g., across the forefoot opening) and then are woven inside and outside of the sidewalls of upper 285 through slits or openings 182.

Figure 19:
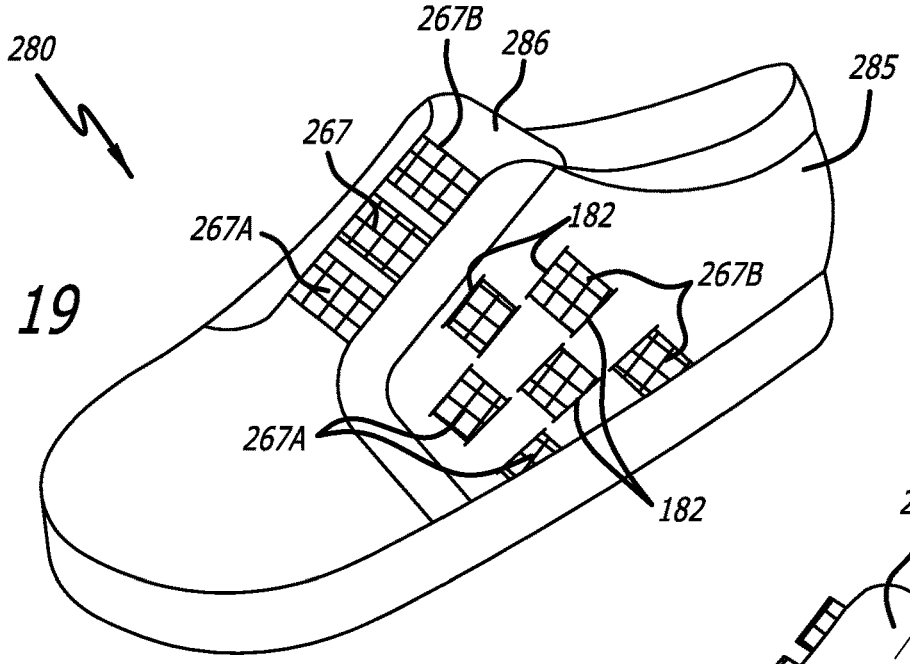
FIG. 19 is a perspective view of a shoe according to a twelfth representative embodiment of the present invention.
Figure 20:
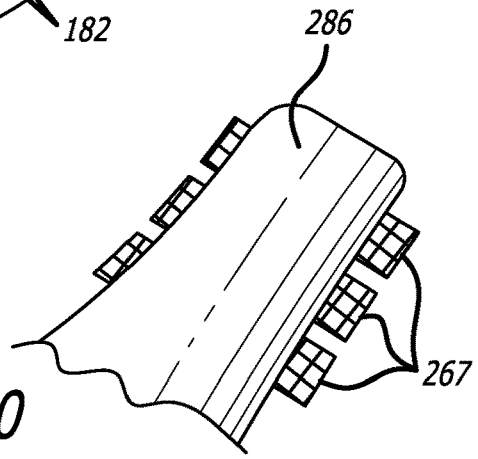
FIG. 20 is a perspective view of a shoe tongue according to a variation on the twelfth representative embodiment of the present invention.

In the immediately preceding embodiment, the strips of elastic web 267 run across the top surface of the tongue 286. However, in a somewhat modified variation on the preceding embodiment, as shown in FIG. 20, such strips instead either attach to or emerge from (e.g., forming a center layer of the tongue 286) the side edge of the tongue 286. Otherwise, the configuration of shoe 280 can be the same in FIG. 20 as depicted in FIG. 19.

Figure 21:
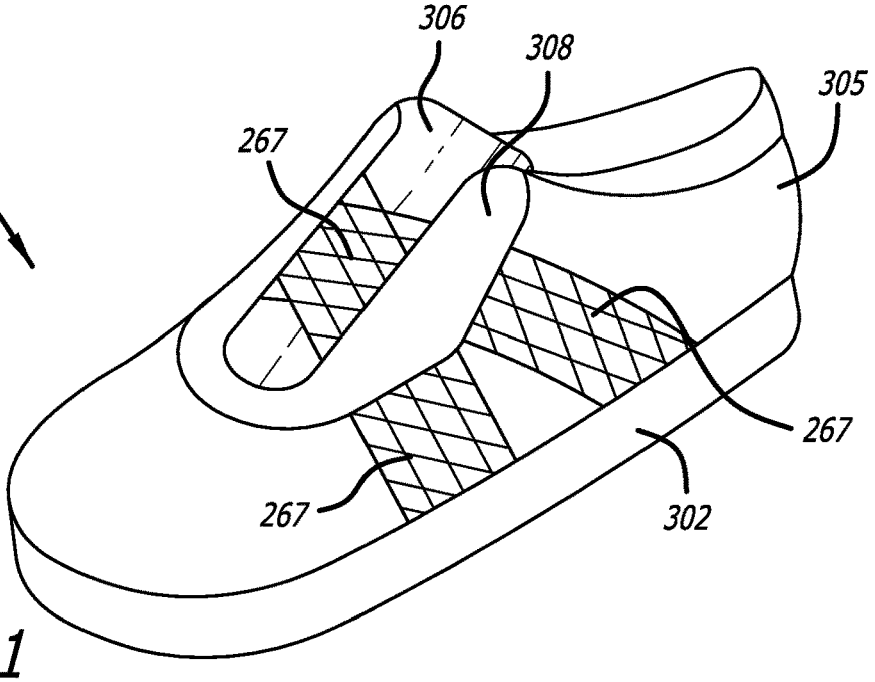
FIG. 21 is a perspective view of a shoe according to a thirteenth representative embodiment of the present invention.

A still further shoe 300 is illustrated in FIG. 21. As shown, similar to some of the previous embodiments, shoe 300 also incorporates an elastic web 267. However, in this embodiment the web 267 material is provided in the shape of an "X", with its crossing portion disposed over the top of the tongue 306 (within the forefoot opening), and with its extending portions (two on each side) passing underneath a strip of material 308 that borders the forefoot opening (in the present embodiment, a U-shaped strip 308, with a segment on each of the left and right sides and an adjoining segment forward of the forefoot opening) and then reemerging and running along the outside surface of the sidewall of upper 305, ultimately attaching to the bottom portion of the upper 305 or to the sole 302. Although the present configuration provides multiple anchor points for the X-shaped elastic web 267 (e.g., beneath strip 308 and where the distal ends of the elastic web 267 attached to the upper 305 or the shoe sole 302), in alternate embodiments other configurations are used (e.g., with different sections inside of and/or outside of the upper 305).

In the foregoing embodiments, one or more (preferably multiple) elastic straps or straps segments (e.g., in the form of laces 147, flat strips 177 or a web 267) cross over the shoe's tongue and/or attach to it. Although the foregoing embodiments are preferred, any of the types of straps described above can be used in any of the configurations discussed above.

Figure 22:
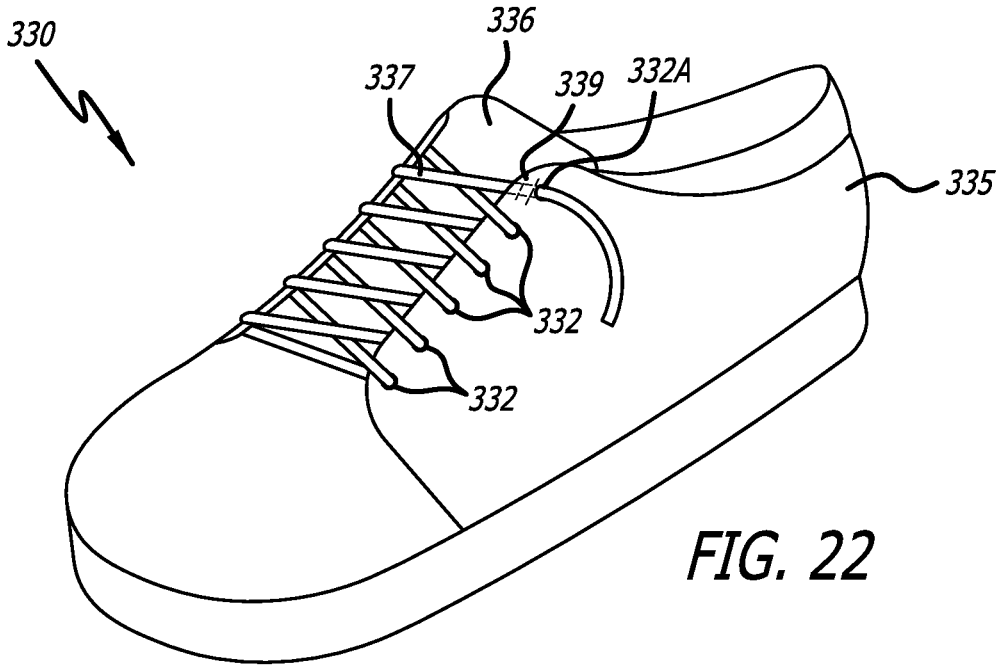
FIG. 22 is a perspective view of a shoe according to a fourteenth representative embodiment of the present invention.

A still further shoe 330 according to the present invention is shown in FIG. 22. Generally speaking, shoe 330 appears similar to conventional lace-up shoes, with a row of eyelets 332 on each side of the forefoot opening under which the tongue 336 extends, and with a lace 337 (e.g., having a circular cross-section) woven back and forth between such eyelets 332 so that it crosses itself a plurality of times, e.g., in the manner of a conventional shoelace. Unlike a conventional shoe, however, lace 337 preferably is fixedly attached to the upper 335 of the shoe 330, e.g., at or near the topmost eyelets (i.e., eyelet 332A and the opposite eyelet on the right side of the shoe 330). In the present embodiment, lace 337 is stitched at position 339 on the interior of the sidewall of the upper 335, just prior to exiting through eyelet 332A, and then lace 337 just hangs loosely along the exterior of the sidewall of upper 335. This configuration provides the wearer with the carefree look of not having tied the shoelace 337 and, in fact, is more convenient for the wearer because no tying is required. At the same time, because lace 337 is elastic it can still secure the shoe 332 the wearer's foot and a still open up to accommodate insertion and removal of the wearer's foot.

Figure 23:
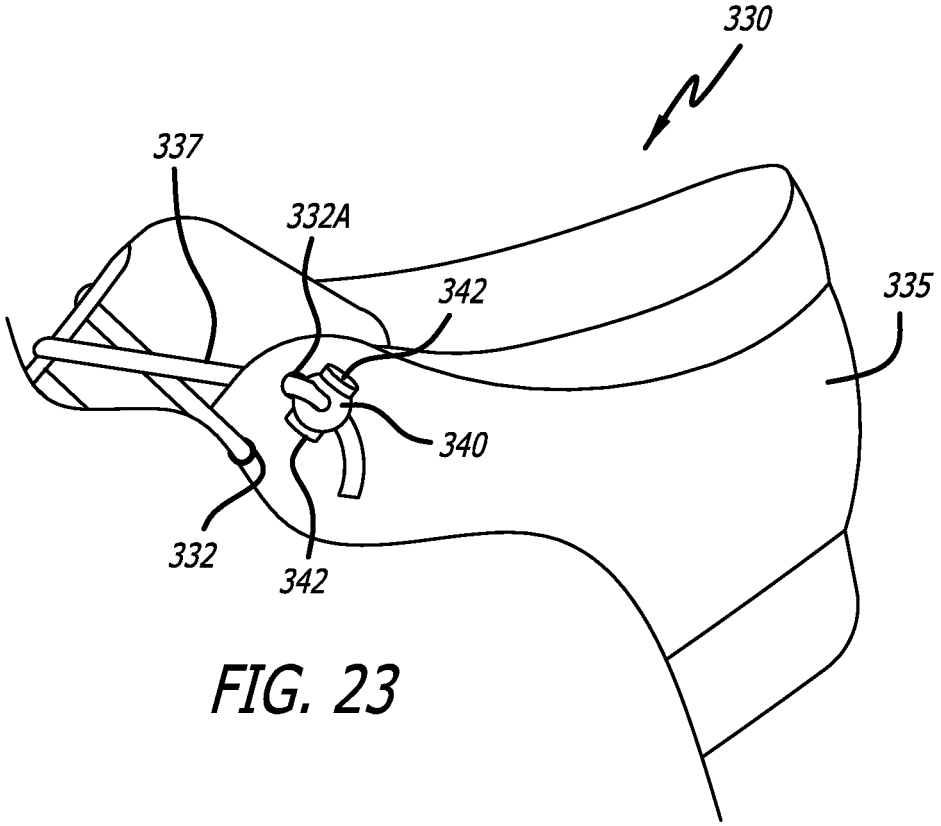
FIG. 23 is a perspective view of a portion of a shoe that employs a latching mechanism for tightening laces according to a modified version of the fourteenth representative embodiment of the present invention.

In the foregoing embodiment, the lace 337 preferably is fixedly attached to each side of the shoe 330 in a permanent manner (i.e., permanent relative to ordinary everyday use, e.g., stitched). In a somewhat modified version, shown in FIG. 23, rather than being fixedly attached. In such a permanent manner, lace 337 instead is fixedly attached to the upper 335 only when desired by the wearer (e.g., by default) but also can be slid relative to the upper 335 as and when desired by the wearer (e.g., without substantial effort). More specifically, in this particular variation a clamping mechanism 340 is attached to the upper 335 just outside of each of the topmost eyelets (e.g., eyelet 332A). By default, clamping mechanism 340 clamps onto the lace 337. However, by pressing spring-loaded release buttons 342, the clamping force is released so that lace 337 can freely slide, forward or backward, through clamping mechanism 340.

In certain more-specific embodiments, the clamping surfaces on the interior of mechanism 340 have angled teeth so that lace 337 is capable of being pulled outwardly even when the clamping force is being applied, and the clamping mechanism 340 is fixedly attached (e.g., stitched and/or glued) to the upper 335. As a result of this configuration, the user can tighten the laces simply by pulling on them, and then can loosen them by pressing buttons 342.

However, in still further variations, clamping mechanism 340 is simply held in place by the forces exerted by the lace 337 and the opposing surface of the sidewall of the upper 335 (e.g., with clamping mechanism 340 being larger than eyelet 332A). In even further variations, clamping mechanism 340 is disposed on the interior surface of the sidewall of the upper 335 (e.g., and fixedly attached to such surface). Also, although elastic laces 337 are preferred in the present embodiment, non-elastic laces also can be used in conjunction with the present clamping mechanism 340 (e.g., because clamping mechanism 340 can provide a simple method to increase and/or release tension in the lace 337, rather than relying on elastic forces).

It is noted that each of FIGS. 14-23 mainly show the left side of a particular shoe. Preferably, for each such embodiment, the right side of the shoe is substantially the mirror image of the right side, or at least has the same kind of structures (e.g., the same kinds of interactions between the straps and the shoe's upper) as depicted for the subject shoe's left side.

In the foregoing embodiments, elastic straps are used. However, as discussed above, the present invention also provides additional features (e.g., looping elements and/or tensioning elements) that can be used in conjunction with non-elastic straps, as will be readily apparent to those skilled in the art.

Also, in some of the foregoing embodiments different types of straps partially extend along the outside of the sidewall of the shoe's upper, between adjacent slits in the upper. In a modified configuration, the upper is completely open between such slits (e.g., having small rectangular windows or openings) and the strap(s) are simply visible through such openings. In such a modified configuration, the strap(s) preferably fixedly attach to one or more points on the interior of the upper's sidewalls.

Additional Considerations.

In the event of any conflict or inconsistency between the disclosure explicitly set forth herein or in the attached drawings, on the one hand, and any materials incorporated by reference herein, on the other, the present disclosure shall take precedence. In the event of any conflict or inconsistency between the disclosures of any applications or patents incorporated by reference herein, the disclosure having the most recent priority date shall take precedence.

Unless clearly indicated to the contrary, words such as "optimal", "optimize", "minimize", "best", as well as similar words and other words and suffixes denoting comparison, in the above discussion are not used in their absolute sense. Instead, such terms ordinarily are intended to be understood in light of any other potential constraints, such as user-specified constraints and objectives, as well as cost and processing constraints.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

In the discussions above, the words "include", "includes", "including", and all other forms of the word should not be understood as limiting, but rather any specific items following such words should be understood as being merely exemplary.

References herein to a "criterion", "multiple criteria", "condition", "conditions" or similar words which are intended to trigger, limit, filter or otherwise affect processing steps, other actions, the subjects of processing steps or actions, or any other activity or data, are intended to mean "one or more", irrespective of whether the singular or the plural form has been used. For instance, any criterion or condition can include any combination (e.g., Boolean combination) of actions, events and/or occurrences (i.e., a multi-part criterion or condition).

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe comprising:

a sole;

an upper, extending above the sole and defining an approximately U-shaped forefoot opening, that includes a front section, a first side, a second side, a rear section, and a tongue that originates from the front section and extends rearwardly between the first side and the second side under the forefoot opening; and a first elastic lace, extending over and across the tongue from the first side to the second side, looping around, by extending around the external circumference of, an element that is at least one of disposed inside of, or embedded within, the upper, and then extending over and across the tongue from the second side back to the first side; and a second elastic lace that at least one of (a) is fixedly attached close to an edge of the approximately U-shaped forefoot opening or (b) runs between layers of the upper and is anchored close to the base of the shoe.

2. A shoe according to claim 1, wherein the second elastic lace crosses just a single time from the first side to the second side, has a first end that is fixedly attached to the first side, and has a second end that is fixedly attached to the second side.

3. A shoe according to claim 2, wherein the first end of the second elastic lace has been at least one of stitched or glued to the first side, and the second end of the second elastic lace has been at least one of stitched or glued to the second side.

4. A shoe according to claim 2, wherein the second elastic lace extends just one time between the first end and the second end.

5. A shoe according to claim 2, wherein the first end of the second elastic lace is fixedly attached close to the edge of the first side, and the second end of the second elastic lace is fixedly attached close to the edge of the second side.

6. A shoe according to claim 1, wherein the element is rotatable.

7. A shoe according to claim 1, wherein the element is embedded between layers of the upper.

8. A shoe according to claim 1, wherein the first elastic lace extends over and across the tongue more than two times.

9. A shoe according to claim 1, wherein the element is disposed close to the edge of the second side.

10. A shoe according to claim 1, wherein the first elastic lace is tubular-shaped.

11. A shoe according to claim 1, wherein the first elastic lace has a first end that is fixedly attached close to the edge of at least one of the first side or the second side.

12. A shoe according to claim 11, wherein the first elastic lace has a second end that is fed through an opening in an inner wall of upper.

13. A shoe according to claim 12, wherein the first elastic lace has a second end that is fixedly attached at least one of (a) lower on the upper or (b) to the sole.

14. A shoe according to claim 1, wherein the second elastic lace extends over and across the tongue from the first side to the second side, and then runs between layers of the upper in at least one of the first side or the second side.

15. A shoe according to claim 14, wherein the second elastic lace is anchored close to a base of the shoe.

16. A shoe according to claim 14, wherein the second elastic lace enters an opening within an inner layer of upper, thereby permitting said second elastic lace to run between said layers of the upper in at least one of the first side or the second side.

17. A shoe according to claim 16, wherein the opening is close to the edge of said at least one of the first side or the second side.

18. A shoe according to claim 14, further comprising a third elastic lace that crosses just a single time from the first side to the second side, has a first end that is fixedly attached close to the edge of the first side, and has a second end that is fixedly attached close to the edge of the second side.

* * * * *